United States Patent [19]

von der Eltz et al.

[11] 4,198,204

[45] Apr. 15, 1980

[54] SHORT LIQUOR DYEING PROCESS FOR PIECE GOODS, MADE FROM CELLULOSE FIBERS, IN ROPE FORM

[75] Inventors: Hans-Ulrich von der Eltz, Frankfurt am Main; Joachim W. Lehmann, Kelkheim; Erwin Ungermann, Steinbach; Edwin Hümüller, Hofheim am Taunus; Karl-Heinz Keil; Joachim Ribka, both of Offenbach am Main, all of Fed. Rep. of Germany

[73] Assignee: Hoechst Aktiengesellschaft, Frankfurt, Fed. Rep. of Germany

[21] Appl. No.: 853,997

[22] Filed: Nov. 22, 1977

[30] Foreign Application Priority Data

| | | | |
|---|---|---|---|
| Nov. 27, 1976 | [DE] | Fed. Rep. of Germany | 2653919 |
| Sep. 14, 1977 | [DE] | Fed. Rep. of Germany | 2741266 |
| Sep. 14, 1977 | [DE] | Fed. Rep. of Germany | 2741267 |
| Oct. 25, 1977 | [DE] | Fed. Rep. of Germany | 2747699 |

[51] Int. Cl.[2] ..... D06P 3/82; D06P 3/60

[52] U.S. Cl. ..... 8/21 R; 8/1 A; 8/34; 8/35; 8/37; 8/46; 8/54.2; 8/85 R; 8/86; 8/89 R

[58] Field of Search ..... 8/21 R, 54.2, 1 A, 34, 8/35, 37, 89 R, 85 R, 86, 93, 46

[56] References Cited

U.S. PATENT DOCUMENTS

| | | | |
|---|---|---|---|
| 3,762,866 | 10/1973 | Rayment et al. | 8/149.1 |
| 3,921,420 | 11/1975 | Aurich et al. | 68/5 C |
| 3,954,394 | 5/1976 | Meier-Windhorst | 8/17 |
| 4,001,945 | 1/1977 | Aurich et al. | 34/155 |

FOREIGN PATENT DOCUMENTS

| | | |
|---|---|---|
| 772950 | 1/1972 | Belgium . |
| 2322052 | 11/1973 | Fed. Rep. of Germany . |
| 2718941 | 11/1977 | Fed. Rep. of Germany . |
| 7212053 | 3/1973 | Netherlands . |
| 7214779 | 5/1973 | Netherlands . |
| 7214780 | 5/1973 | Netherlands . |
| 7214842 | 5/1973 | Netherlands . |
| 1406665 | 9/1975 | United Kingdom . |

*Primary Examiner*—A. Lionel Clingman
*Attorney, Agent, or Firm*—Curtis, Morris & Safford

[57] ABSTRACT

Process for dyeing mesh fabrics and woven fabrics, made from cellulose fibers and mixed yarns thereof, in rope form on a winch beck or jet dyeing apparatus by the exhaustion method at a short liquor ratio in the presence of at least one auxiliary, using an aqueous liquor containing dyes or dye precursors which are suitable for the type of fiber and optionally fixing chemicals, wherein dyeing is carried out at a liquor ratio of 1:3 to 1:8 (on the weight of the dry goods) and 2–8 g/l of an anionic or non-ionic, aliphatic softener are used, on its own or as a mixture, as the auxiliary.

25 Claims, No Drawings

SHORT LIQUOR DYEING PROCESS FOR PIECE GOODS, MADE FROM CELLULOSE FIBERS, IN ROPE FORM

The present invention relates to a short liquor dyeing process for piece goods, made from cellulose fibers, in rope form.

The dyeing of knitted fabrics, made from cellulose fibers, in rope form is chiefly carried out on winch becks, in some cases on winch becks of a special design, at liquor ratios above 1:10, in most cases between 1:20 and 1:30, using exhaustion dyeing processes. These high liquor ratios have hitherto been necessary because of the high sensitivity of the mesh fabrics to mechanical stress when running on the winch beck, and the requirement to produce level dyeings. It has been thought, on the basis of many years of experience and trials in industry, that creases and, above all, abrasion marks, which cause concern, could only be avoided if the goods float in the liquor. Concerning this, it has been asserted that only floating goods are sufficiently relieved from the weight of the layers of loops and curls of the ropes of goods and can be conveyed from the winch in a satisfactory manner and without distorting the loop. Furthermore, the opinion has been held that adequate removal of folds in the ropes, which is a prerequisite for avoiding creases, is only guaranteed at long liquor ratios.

Experiments which have as their objective lowering the liquor ratio when dyeing piece goods, made from cellulose fibers, in rope form on a winch beck to figures below 1:15, have been carried out in many places; they have, however, been unsuccessful owing to the fact that it has not been possible to obviate the running difficulties described above. Even specially constructed winch becks have not made it possible to reduce the liquor ratio to the extent desired.

As far as dyeing processes are concerned, no difficulties seem to stand in the way of shortening the liquor ratio, since dyeing processes with a liquor ratio of 1:3 to 1:5 have been known for a long time, for example dyeing on the jig. However, the jig is not suitable for dyeing mesh fabrics in rope form (Internationales Lexikon Textilveredlung und Grenzgebiete [International Encyclopedia of Textile Finishing and Related Fields], Fischer-Bobsien, 4th edition, 1975, pages 745, 1,566 and 1,562). A pass on the jig takes much too long for thin fabrics. For this reason, when the jig is fully charged, it is no longer possible to obtain a dyeing which is level from end to end. Textiles of this type are, therefore, often dyed on winch becks. For the reasons which have been described, the conventional winch beck is encountered wherever mesh fabrics and fairly light woven fabrics have to be dyed.

It has, therefore, been necessary, solely on account of the abovementioned running difficulties, to accept the long liquor ratio, with all its disadvantages, such as high consumption of water, high expenditure on energy for heating these quantities of water, high requirement of auxiliaries, reduced tinctorial yield and the like, for dyeing knitted and woven fabrics in rope form.

The large quantities of electrolytes required when dyeing with reactive dyes are also correspondingly reduced at short liquor ratios, because for the electrolytes it is only their concentration that is important. Consequently, however, it is in turn no longer necessary to dissolve such substances in the large quantities, quoted in g/l, such as result at liquor ratios above 1:15.

It has now been found that piece goods, made of cellulose fibers or mixed yarns thereof, in rope form can be dyed by the exhaustion process on conventional winch becks or jet dyeing apparatus using a short liquor ratio, if, in addition to the dyes, an anionic or non-ionic, aliphatic softener, or a mixture of softeners, which makes the fibers supple and surrounds them with a smoothing film, is added to the dye bath.

The subject of the present invention is therefore a process for dyeing mesh fabrics and woven fabrics, made from cellulose fibers or mixed yarns thereof, in rope form on a winch beck or jet dyeing apparatus by the exhaustion method at a short liquor ratio in the presence of at least one auxiliary, using an aqueous liquor containing dyes or dye precursors which are suitable for the type of fiber and optionally fixing chemicals, wherein dyeing is carried out at a liquor ratio of 1:3 to 1:8 (on the weight of the dry goods) and 2–8 g/l of an anionic or non-ionic, aliphatic softener are used, on its own or as a mixture, as the auxiliary.

Oxethylates, for example oxethylates having 8–32 C atoms, are primarily cited as non-ionic softeners of aliphatic origin which are suitable for the process of the present invention. The following have proved suitable in this respect: polyethylene glycols having an average molecular weight between 400 and 800 and fatty acid condensation products, in particular 80–100 percent strength by weight formulations of 1,4-butanediol monostearate, etherified with 7 moles of ethylene oxide, or 20–50 percent strength by weight formulations of a condensation product formed from stearic acid and ammonia which has been oxethylated with 5 moles of ethylene oxide. Compounds of this type are accessible by appropriate processes.

Equally, however, higher-molecular oxyethylates, such as, for example, ethylene oxide/propylene oxide block polymers which can optionally be alkylated on both sides, can also be employed with success in accordance with the invention.

The block polymer used in accordance with the invention can be built up in such a way that the ethylene oxide and propylene oxide blocks in it have a random distribution and vary in size, both in their molecular units and as regards their type. It is also possible for the ethylene oxide and propylene oxide block units to alternate, so than an alternating composition results.

The block polymers described can be alkylated at a terminal position, the alkyl radical being composed either of lower (1 to 7 C atoms) alkyl groups or of higher (8–18 C atoms) alkyl groups. In this connection, the alkyl groups at the two ends of the block polymer can be identical; they can, however, also be different, for example in the case of a block polymer which contains a $C_8$ to $C_{18}$ alkyl radical at one end and a $C_1$ to $C_7$ alkyl radical at the other end. These can optionally be branched or unsaturated radicals. Preferably, block polymers containing alkyl radicals of 2 to 5 C atoms on both sides are used.

The average molecular weight of the block polymers, based on the non-alkylated core composed of ethylene oxide and propylene oxide units, is 220 to 5,200; it is preferable to employ those non-alkylated block polymers which have a molecular weight of 2,000 to 5,000. The molecular weight and the composition of the products are appropriately selected in such a way that adequate solubility in water results.

Block polymers of this type can be obtained by customary methods of polymerization.

Among the anionic softeners which are used in accordance with the invention, aliphatic compounds of this type having 8–32 C atoms should be mentioned. Examples of auxiliaries of this type are sulfonated and oxethylated fatty acid condensation products in which the proportion of fatty acid which has not been reacted or has only been sulfonated is 3–60 percent by weight, or 40–50 percent strength by weight mixtures of sulfonated oleic acid butylamide and oleic acid sulfonate in a ratio by weight of 2:1 to 1:1.

The last-mentioned auxiliaries consisting of sulfonated oleic acid butylamide/oleic acid sulfonate can also be employed successfully as a mixture with N-alkyl-α-sulfosuccinamic acids, or salts thereof, according to the general formula I $$\begin{array}{l} CH_2-CONH-R \\ | \\ CH-SO_3^{(-)}X^{(+)} \\ | \\ COO^{(-)}X^{(+)} \end{array} \qquad (I)$$

wherein R denotes a branched or unbranched alkyl or alkenyl group having 10 to 30 C atoms, preferably 12 to 20 C atoms, or a group of the formula $R'—NH—(CH_2)_n—$, n denotes an integer from 2 to 4, X denotes a sodium, potassium or ammonium ion and R' has the same meaning as R.

Finally, N-alkyl-α-sulfosuccinamic acid, or salts thereof, of the preceding formula I can also be used successfully, in accordance with the present invention, as a mixture with glycerol ether derivatives according to the general formula II $$\begin{array}{l} CH_2-OR^1 \\ | \\ CH_2-O-(CH_2CH_2O)_Y-Z \\ | \\ CH_2-OR^2 \end{array} \qquad (II)$$

wherein $R^1$ and $R^2$ denote identical or different, branched or unbranched $C_4$–$C_8$ alkyl groups, preferably branched $C_8$ alkyl groups, Y denotes zero or a number from 1 to 4 and Z denotes a group of the formulae $—(CH_2)_m—COOMe$, $—SO_3Me_2$ or $PO_3Me_3$, m denoting 1, 2 or 3 and Me denoting an alkali metal ion, ammonium ion or trialkylammonium ion.

The mixture consisting of sulphonated oleic acid butylamide/oleic acid sulfonate which is used as the softener is obtained by converting oleic acid into the corresponding acid chloride, reacting the latter with the amine and sulfonating the double bond (Lindner, Tenside-Textilhilfsmittel-Waschrohstoffe [Surface-active Agents, Textile Auxiliaries and Detergent Raw Materials], Volume I, page 635; German Patent Specifications Nos. 1,297,074, 634,032, 695,173, 678,731 and 671,085), for example by means of sulfuric acid monohydrate in trichloroethylene. Further free oleic acid is added before the sulfonation for the desired mixture of auxiliaries.

The N-alkyl-α-sulfosuccinamic acids of the formula I are known from U.S. Pat. No. 2,427,242 and from J.Am.Oil Chem.Soc. 51 (1974), pages 297–301. They are prepared by reacting maleic anhydride with a long-chain amine and a subsequent addition reaction with sodium pyrosulfite. Suitable long-chain amines are amines having the number of carbon atoms indicated above, in particular amines having an alkyl chain which is derived from naturally occurring fatty acids, such as stearylamine, palmitylamine or oleylamine, or from naturally occurring mixtures of fatty acids, such as tallow fatty amine or coconut fatty amine.

The glycerol derivatives of the formula II are obtained by reacting 1,3-dialkoxypropan-2-ols, or ethoxylation products thereof, with ω-halogenoalkanecarboxylic acids, ω-halogenoalkanesulfonic acids or ω-halogenoalkanephosphonic acids in accordance with the instructions of German Patent Specification No. 1,256,640 or by esterifying these ethoxylation products of 1,3-dialkoxypropanols with sulfuric or phosphonic acid (DT-OS No. 2,139,448). The sum of the C atoms in the two radicals $R^1$ and $R^2$ should preferably be between 10 and 16 for the glycerol ether derivatives of the formula II.

Within the scope of the process according to the invention, the anionic and non-ionic softeners cited can appropriately be used as mixtures of themselves or with one another. Ethylene oxide adducts, for example those based on long-chain alcohols ($C_{12}$–$C_{20}$) or $C_4$–$C_9$ alkylphenols, preferably nonylphenol, are additionally used in certain cases as a further non-ionic blending component. Their degree of oxethylation is generally 20–80, preferably 20–30, units of ethylene oxide per OH group. In some cases it is also advantageous, for the process claimed, to add a polyethylene glycol according to the general formula III $$HO(CH_2CH_2O)_pH \qquad (III)$$

wherein p denotes a number from 100 to 400, preferably 100 to 250. These are commercially available waxes having a molecular weight between 4,000 and 10,000.

The pre-treatment of the textile material merits particular attention of this new process, since a uniform and rapid distribution of the reduced quantity of liquor in the material to be dyed is only ensured by the goods having a high absorbency. However, it is precisely the running behavior of the knitted fabrics and other mesh fabrics that is impaired by an effective pre-treatment, which in most cases consists in boiling under alkaline conditions. This is because the natural, smoothing constituents of the cotton and any dressings which may be present are thereby removed from the material to be dyed. This poorer running behavior, caused by the pre-treatment, and the higher concentration of dye in the short dye liquor thus increase the risk of obtaining uneven dyeings. When dyeing with reactive dyes and direct dyes, there is the further factor that the high concentrations of electrolyte which are required for dyeing cause a further reduction of the smoothness of the material and thus in no way improve the initial situation.

In general, therefore, the material to be dyed is boiled under alkaline conditions before dyeing and is then dyed, best when still wet or moist. In this way the high costs of intermediate drying are saved. The moisture present in the ropes is then subtracted from the quantity of liquor in the dye bath, that is to say it is also taken into consideration in the liquor ratio of 1:3 to 1:8.

The alkaline boiling can be avoided by using a mixture of wetting agents which is known from DT-OS No. 2,360,985. In accordance with this procedure, the gray goods are wetted out in the winch beck, the wetting agents are rinsed out and the moisture present in the goods is allowed for in calculating the liquor ratio of 1:3 to 1:8.

Short liquor dyeing processes in which the liquors can contain 0.2 to 10 g/l (or 0.2 to 6 g/l) of an anionic or non-ionic, aliphatic surface-active agent are already known from DT-OS No. 2,254,498 and DT-AS No. 2,254,497. Practical examples which document the dyeing of cellulose ropes on a winch beck in accordance with this procedure are, however, not disclosed in the literature references mentioned. Accordingly, it was not possible for the process according to the invention to be suggested by this state of the art, the more so as the auxiliaries used here are not mentioned in the publications cited above, either individually or by the more detailed type, and thus any reference to the behavior of these agents is lacking.

It is surprising to the expert that, without a radical alteration in the normal dyeing processes, merely by adding the abovementioned auxiliaries, the running behavior of the ropes of goods can be affected in such a way that it is possible to shorten the liquor ratio to values of 1:3–1:8, and that level and deep dyeings are obtained, although unfavorable results have hitherto been recorded in industry.

The process claimed is carried out in a manner which does not differ from the known dyeing processes on conventional winch becks, but which is characterized by the drastic shortening of the liquor ratio to values of 1:3 to 1:8, preferably 1:5 to 1:8, and by the addition of the abovementioned auxiliaries to the dyeing liquors in quantities of 2–8 g/l. The softeners to be employed are based on the liquor ratio used (that is to say 1:3 to 1:8). The time and temperature parameters are not changed in accordance with the process.

The dyeing temperature, which still has a great effect on the tinctorial yield when dyeing on a jig, surprisingly no longer plays such an important part when dyeing with reactive dyes in accordance with the new process. Dyeings which are carried out for the same dyeing time but in one case at an elevated temperature (60° C.) and in another case at 40° C., do not exhibit the strong differences in depth of shade which are found with similar dyeings on a jig.

When carrying out the new short liquor dyeing process, it is advantageous first to divide up the liquor for wetting out the goods, for dissolving dye and for dissolving auxiliaries and chemicals and to re-combine, for dyeing, these liquor fractions only in the winch beck, to give the total dyeing liquor, which then contains all its constituents and additives.

It has proved to be advantageous to employ winch becks of flat construction for the process according to the invention and, as far as possible, to dye ropes of the same length in one dyeing batch.

A further advantage of the short liquor dyeing process described in this text is the markedly reduced effluent pollution caused by the dye bath additives which, in general, are calculated in g/l and are therefore present in a markedly reduced quantity at the diminished liquor ratio. A cost saving is also associated with the reduced quantities employed.

Suitable dyes for the present process are preferably the substantive dyes which are designated direct dyes in the Color Index, 3rd edition (1971), and also leuco vat ester dyes, designated solubilized vat dyes in the Color Index, and combinations of azoic coupling compoents and azoic diazo components, also known as developing dyes. Vat dyes and sulfur dyes are also suitable, insofar as they can be employed in winch beck dyeing.

Reactive dyes which can be employed in the present process are the organic dyes which are known under this term. These are predominantly dyes which contain at least one group capable of reacting with polyhydroxyl fibers, a precursor thereof or a substituent capable of reacting with polyhydroxyl fibers. Suitable parent substances of organic dyes of this type are, in particular, dyes from the series of the azo, anthraquinone and phthalocyanine dyes, it being possible for the azo and phthalocyanine dyes either to be metal-free or to contain metal. Examples which may be mentioned of reactive groups, and precursors which form such reactive groups in an alkaline medium, are epoxy groups, the ethyleneimide group, the vinyl grouping in the vinylsulfonyl radical or in the acrylic acid radical, and also the β-sulfatoethylsulfonyl group or the β-chloroethylsulfonyl group. Derivatives of the tetrafluorocyclobutyl series, for example of tetrafluorocyclobutylacrylic acid, can also be used for this process. Suitable reactive substituents in reactive dyes are those which can be split off readily and leave behind an electrophilic radical. Examples of substituents of this type which may be mentioned are halogen atoms on the following ring systems: quinoxaline, triazine, pyrimidine, phthalazine and pyridazone. It is also possible to use dyes which have several reactive groups of different types.

Other suitable additives for the dyeing liquors are the auxiliaries and chemicals which are known for dyeing, for example the fixing alkalis sodium hydroxide, sodium carbonate, trisodium phosphate and others.

Wetting agents are generally not required in accordance with the process, since good wettability of the goods is a prerequisite for carrying out the process. In cases where the goods have been intermediately dried after the pre-treatment and before dyeing, wetting agents can, however, prove advantageous for rapid re-wetting.

If dyeing is carried out by the process according to the invention, that is to say at liquor ratios of 1:3 to 1:8, a further advantage which results is that, for example, the shortening of the liquor ratio is not achieved by using less liquor at a normal, that is to say unchanged, charge of the winch beck with goods, but by the fact that the winch beck can be charged with a greater quantity of goods for the same quantity of liquor.

A greater quantity of textile material is therefore dyed during one dyeing cycle.

Thus it is plain that a larger number of ropes of normal length is dyed and it is surprising to the expert that, contrary to his expectations, the ropes have not become entangled or snarled.

If the winch beck is improved by providing perforated baffle separators between the individual ropes, it is even possible to dye by means of the new process at even shorter liquor ratios, for example 1:4 to 1:3.

As in the case of winch becks, it is also possible to carry out the claimed process on all apparatus in which the goods are conveyed in rope form, for example jet dyeing apparatus.

The new process is suitable for all cellulose-containing fibers and also for mixed yarns thereof with synthetic fibers.

The Examples which follow are intended to demonstrate the process in various embodiments, but not to limit it in any way to specific embodiments since operational and mechanical requirements are often the deciding factor in this respect.

EXAMPLE 1

50 kg of a cotton knitted fabric (fine-rib) which has been boiled and possesses good absorbency are prepared for dyeing in a winch beck in 5 ropes.

100 l of the total of 250 l of aqueous liquor are used for wetting out the goods. 6 g/l of polyethylene glycol having an average molecular weight of 600 are dissolved as the softener in these 100 l of water.

A further 50 l of liquor are used to dissolve the dye and 100 l are used to dissolve the required salt and alkali.

For a 2.5% strength dyeing, 1.25 kg of the commercially available reactive dye of the formula

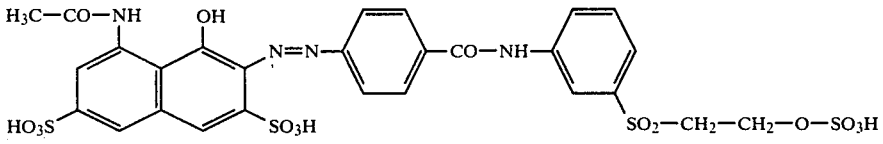

are dissolved in 20 l of boiling water and the solution is further diluted with a further 30 l of hot water.

7.5 kg of calcined sodium sulfate and 750 $cm^3$ of 32.5% strength sodium hydroxide solution are dissolved in 100 l of warm water (60° C.).

These three solutions are now run into the winch beck and are combined to form the dyeing liquor. By virtue of its content of polyethylene glycol, the liquor distributes itself very rapidly and uniformly in the ropes of knitted fabric. The textile material is then dyed in the customary manner. After a dyeing time of 90 minutes at 40° C., the ropes are rinsed with water, after-treated in the usual manner and dried.

A level red dyeing of the cotton knitted fabric is obtained. In spite of the liquor ratio being reduced to 1:5, virtually no running difficulties have occurred. There has been no impairment of the dyeing.

Comparison Test

The test was carried out as in Example 1, but the addition of 6 g/l of polyethylene glycol was not made. After drying, the dyeing exhibited unevennesses caused by loop distortion and poor removal of folds.

EXAMPLE 2

60 kg of cotton fine-rib knitted fabric in the raw condition are wetted out at 30°-40' in a winch beck with an aqueous liquor containing 50 $cm^3$/l of isopropyl alcohol, 5 $cm^3$/l of butanol and 2 g/l of a wetting agent based on sodium diisobutylnaphthalenesulfonate, and are rinsed. After this 180 l of water remain in the goods.

For dyeing at a liquor ratio of 1:8, a further 300 l of aqueous liquor are prepared using 720 g (=2% relative to the weight of the goods) of the commercially available dye Reactive Blue 4 of C.I. No. 61,205; and 2.88 kg (=6 g/l calculated on the total liquor of 480 l) of the softener of the following composition: 90% of 1,4-butane-diol, etherified with 7 moles of ethylene oxide, and 10% of water; and 50 g/l of calcined sodium sulfate and 7 g/l of calcined sodium carbonate.

This liquor is now added to the wet, running ropes and the goods are dyed at room temperature for 90 minutes. The dyeing is then rinsed with water and after-treated in the manner customary for reactive dyeings.

A clear, level blue dyeing of the knitted fabric is obtained. Loop distortion and creases have not occurred.

EXAMPLE 3

7 ropes of a cotton fine-rib knitted fabric which has been boiled and bleached and weighs 95 kg are dyed in a winch beck at a liquor ratio of 1:6.

For this, the ropes are wetted out with 300 l of an aqueous liquor at 40° C. 5 g/l (=1.85 kg calculated on the total liquor of 570 l) of polyethylene glycol having an average molecular weight of 800 have been dissolved in this liquor.

The remaining 270 l of liquor are divided up to dissolve the dye and the chemicals:

1.9 kg (=2% relative to the weight of the goods) of the commercially available dye Reactive Red 22 of C.I. No. 14,824 are dissolved in 70 l of boiling water.

28.5 kg of calcined sodium sulfate and 1.72 kg of 32.5% strength sodium hydroxide solution are also dissolved in 200 l of water at 60° C.

The two solutions are then also run into the winch beck. The textile material is then dyed for 90 minutes without further control of the temperature and is rinsed with water and after-treated in the manner customary for reactive dyes.

A level red dyeing of the knitted fabric ropes is obtained. Loop distortion and creases have not occurred, in spite of the low liquor ratio of 1:6.

EXAMPLE 4

7 ropes of a pretreated cotton fine-rib knitted fabric of good absorbency and weighing 85 kg are dyed in a winch beck at a liquor ratio of 1:4.

The dyeing liquor is prepared by dissolving 1,530 g (=1.8% relative to the weight of the goods) of the commercially available dye Reactive Yellow 17 of C.I. No. 18,852 and 255 g (=0.3% relative to the weight of the goods) of the commercially available dye Reactive Orange 16 of C.I. No. 17,757 in 80 l of boiling water.

The remaining dye bath of 260 l at 40° C. is made up in the winch beck itself using 3 g/l of a 50 percent strength by weight formulation of the condensation product formed from stearic acid and ammonia which has been oxethylated with 5 moles of ethylene oxide, 50 g/l of calcined sodium sulfate, 2 $cm^3$/l of 32.5% strength sodium hydroxide solution and 5 g/l of calcined sodium carbonate.

The ropes are wetted out for 5 minutes in this liquor.

After the dye has been added to this liquor, the winch is allowed to run for 5 minutes at an increased speed and the goods are then dyed at the normal running speed of the winch for a further 90 minutes.

The dyed textile material is then rinsed with warm water (50° C.) and is after-treated in the manner customary for reactive dyeings.

A completely level orange dyeing of the knitted fabric is obtained. In spite of the very short liquor ratio of 1:4, no running difficulties or defects stemming therefrom have occurred in this dyeing.

EXAMPLE 5

6 ropes of thoroughly pretreated cotton flannel are dyed in a winch beck at a liquor ratio of 1:6. The weight of the goods is 80 kg.

For this, the aqueous liquor of 480 l is prepared at 40° C. using 2 g/l of a 50 percent strength by weight formulation of the condensation product formed from stearic acid and ammonia which has been oxethylated with 5 moles of ethylene oxide, 0.2 g/l of calcined sodium carbonate and 1 g/l of sodium 2,2'-dinaphthylmethane-6,6'-disulfonate and 0.5 g/l of sodium nitrite, and the goods are worked in this liquor for 5 minutes.

129.6 g (=0.27 g/l) of the dye Solubilized Vat Orange 3 of C.I. No. 59.301 are dissolved in 4 ml of boiling water and added to the liquor while the winch is running. Development of the dye is started after a dyeing time of 30 minutes and with a falling temperature.

This is done by adding 1.5 $cm^3$/l of concentrated sulfuric acid (previously diluted with cold water in the ratio of 1:10) to the liquor used. The development of the dyeing takes 15 minutes. The dyed goods are then thoroughly rinsed with cold water and after-treated for 10 minutes at the boil. The aqueous after-treatment liquor employed here contains 3 g/l of calcined sodium carbonate and 0.5 g/l of oleylmethyltaurine.

After the dyed material has been rinsed, a fast, level, flesh-colored dyeing is obtained. In spite of the low liquor ratio of 1:6, no running difficulties or defects, such as abrasion marks and other defects, have occured.

A similar tinctorial result is obtained if dyeing is carried out with 0.162% of the dye Vat Orange 3 of C.I. No. 59,300 by the IK process at 40° C. and a falling temperature, instead of the dye mentioned above, and if, instead of sodium carbonate and sodium nitrite, the following chemicals are employed: 9 $cm^3$/l of 32.5% strength sodium hydroxide solution, 4 g/l of hydrosulfite, concentrated powder (sodium dithionite), and 15 g/l of calcined sodium sulfate, as well as 2 g/l of a 50 percent strength by weight formulation of the condensation product formed from stearic acid and ammonia which has been oxethylated with 5 moles of ethylene oxide.

After the dye has been reoxidized, a level dyeing is obtained without running difficulties or defects caused thereby having occurred.

EXAMPLE 6

134 kg of pretreated cotton fine-rib circular-knitted articles, divided into 10 ropes, are dyed in a winch beck at a liquor ratio of 1:8.

In order to avoid running difficulties of the textile material and levelness defects caused thereby, during the dyeing operation, the following auxiliaries are added to the bath (1,100 l) of water, warmed to 40° C., and these auxiliaries are distributed in the liquor and the goods by 5 minutes working: 1 g/l of an auxiliary consisting of 28% by weight of the sodium salt of sulfonated oleic acid butylamide, 16% by weight of oleic acid sulfonate, 56% by weight of water and salts, and 4 g/l of an auxiliary consisting of 40% by weight of sulfonated oleic acid, oxethylated with 20 moles of ethylene oxide, and 60% by weight of oleic acid sulfonate, in the form of a 50% strength aqueous formulation.

0.24% of the dye Reactive Blue 19 of C.I. No. 61,200 and 0.18% of the reactive dye having the formula

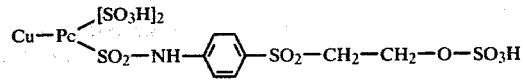

(Cu—Pc=copper phthalocyanine)

(relative to the weight of the goods) are dissolved in hot water and the solution is added to the dye bath and is uniformly distributed therein whilst the winch is running.

After a further 10 minutes, 2.5 g/l of calcined sodium carbonate are introduced into this liquor and, again, after 10 minutes a further 2.5 g/l of calcined sodium carbonate are introduced. Further additions are now made as follows, at intervals of 20 minutes each: 50 g/l of calcined sodium sulfate and 1.5 $cm^3$/l of 32.5% strength sodium hydroxide solution.

After the sodium sulfate has been added, but before the sodium hydroxide solution is added, the dyeing temperature is increased to 60° C. After the sodium hydroxide has, subsequently, also been added, the goods are dyed for a further 60 minutes at 60° C.

The textile material which has been treated in this way is then rinsed with water and then after-treated in the manner customary for reactive dyes.

A light blue level dyeing without any defects which have been caused by running difficulties is obtained.

EXAMPLE 7

20 kg of a cotton Interlok fabric in rope form which is ready for dyeing are dyed in a winch beck with an aqueous dyeing liquor of 160 liters which has been prepared as follows: 600 g of the reactive dye of the formula

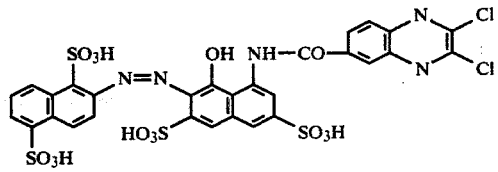

in a commercially available form and condition are dissolved in 20 l of boiling water.

7.5 kg of calcined sodium sulfate and 8 g/l of an auxiliary consisting of a 50% strength aqueous formulation of 40% by weight of the sodium salt of sulfonated oleic acid, oxethylated with 13 moles of ethylene oxide, 50% by weight of oleic acid sulfonate and 10% by weight of free oleic acid, are dissolved in the remaining 140 liters of water at 60° C.

The dye solution and the salt/auxiliary solution are now combined to form the dyeing liquor and the textile material is first dyed in this for 30 minutes at 40° C. 3.5 kg of sodium carbonate, dissolved in water, are then added whilst the winch is running and the goods are dyed to completion for a further 60 minutes at 40° C.

The dyed rope material is then rinsed with water, soaped and dried.

In spite of the quantity of liquor, which has been reduced to the ratio of 1:8, a level, crease-free, red dyeing is obtained.

EXAMPLE 8

135 kg of a pretreated cotton knitted fabric, in the form of a circular-knitted article, are dyed, divided into 10 ropes, in a winch beck at a liquor ratio of 1:8.

In order to avoid running difficulties of the textile material and levelness defects caused thereby, during the dyeing operation, the following auxiliaries are added to the bath (1,100 l) of water, warmed to 40° C., and these auxiliaries are distributed in the liquor and the goods by 5 minutes working: 8 g/l of an approximately 20% strength mixture of auxiliaries consisting of 10% of the sulfuric acid half-ester of 10-hydroxyoctadecanoic acid N-dibutylamide, 1% of polyethylene glycol having an average molecular weight of 800,

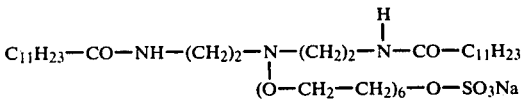

and 2% of lauric acid.

0.84% (relative to the weight of the goods) of the dye Reactive Blue 19 having C.I. No. 61,200 are dissolved in hot water and the solution is added to the dye bath and is uniformly distributed therein while the winch is running.

After a further 10 minutes, 2.5 g/l of calcined sodium carbonate are introduced into this liquor and, 10 minutes later, a further 2.5 g/l of calcined sodium carbonate are again added.

Further additions of 50 g/l of calcined sodium sulfate and 1.5 $cm^3$/l of 32.5% strength sodium hydroxide solution are now made at intervals of 20 minutes each.

During the whole of the dyeing time the temperature of the liquor is kept at 40° C. After the last addition, dyeing of the goods is continued for a further 60 minutes.

The dyed material which has been treated in this way is then rinsed with water and is then after-treated in the manner customary for reactive dyes.

A level blue dyeing is obtained, in spite of the low liquor ratio.

EXAMPLE 9

80 kg of a cotton knitted fabric of good absorbency are dyed in a winch beck at a liquor ratio of 1:6.

This is effected by adding 2 g/l of a block polymer formed from ethylene oxide (EO) and propylene oxide (PO), which has an average molecular weight of 1,300 and in which both end groups are butylated, to a liquor of 480 l of water which is warmed to 40° C. The textile material is worked for 5 minutes in this bath in order to distribute the auxiliary.

The following substances: 1.6 kg (=2% of the weight of the goods) of the dye Reactive Blue 19 of C.I. No. 61,200, dissolved in hot water, 50 g/l of calcined sodium sulfate, 2.5 $cm^3$/l of 32.5% strength sodium hydroxide solution and 5 g/l of calcined sodium carbonate are then added to the liquor in the sequence in which they are listed, while the winch is running, and the goods are dyed for 90 minutes at the controlled temperature of 40° C.

The goods which have been treated in this way are then rinsed with cold water and then with water warmed to 70° C. and are then soaped for 10 minutes at the boil with an aqueous liquor to which is added 0.5 g/l of the reaction product from 1 mole of nonylphenol and 10 moles of ethylene oxide, and finally are rinsed once more with water.

A level blue dyeing is obtained. In spite of the short liquor ratio of 1:6, no running difficulties or defects in the dyeing caused thereby have occurred in this procedure.

The following Examples, arranged in tabular form, report similar results:

| | Dyes | | Auxiliaries | | | | |
|---|---|---|---|---|---|---|---|
| | | | Block polymer EO + PO | | | | |
| Ex. No. | Structure | Amount % | molecular weight | End groups | Amount g/l | Liquor ratio | Color shade |
| 10 | 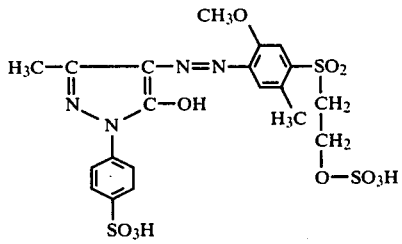 Reactive Black 5- C.I. No. 20,505 | 2 | 2,000 | not alkylated | 2 | 1:4 | brown |
| | 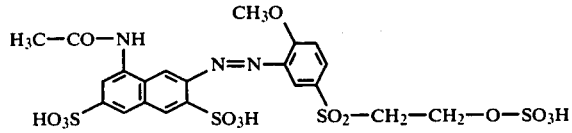 | 1 0.5 | | | | | |

-continued

| Ex. No. | Dyes: Structure | Dyes: Amount % | Auxiliaries: Block polymer EO + PO molecular weight | Auxiliaries: End groups | Auxiliaries: Amount g/l | Liquor ratio | Color shade |
|---|---|---|---|---|---|---|---|
| 11 | 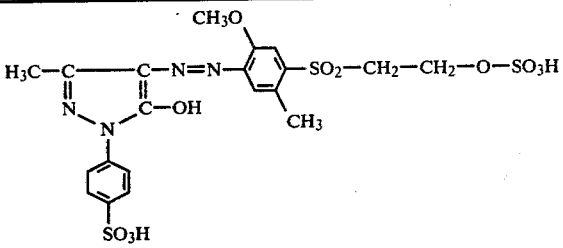 | 1.5 | 800 | dodecyl radical on both sides | 2 | 1:6 | yellow |
| 12 | 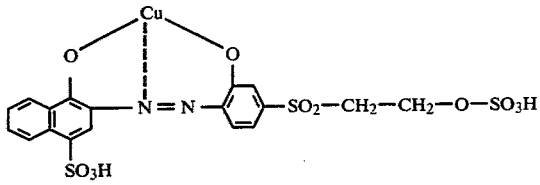 | 2.8 | 400 | butylated on both sides | 6 | 1:4 | claret |
| 13 | 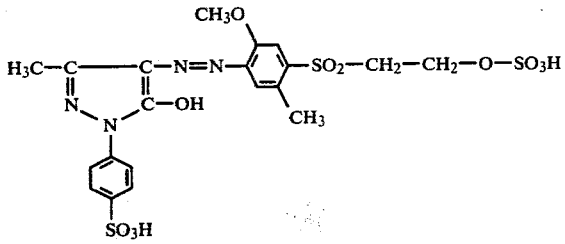 | 3 | 1,500 | butylated on one side | 8 | 1:3 | orange |
| | Reactive Orange 16-C.I. No. 17,757 | 0.5 | | | | | |
| 14 | Reactive Orange 16-C.I. No. 17,757 | 3 | 3,000 | octadecyl radical and | 2 | 1:8 | bright red |
| | Reactive Yellow 17-C.I. No. 18,852 | 0.6 | | ethyl radical | | | |
| 15 | 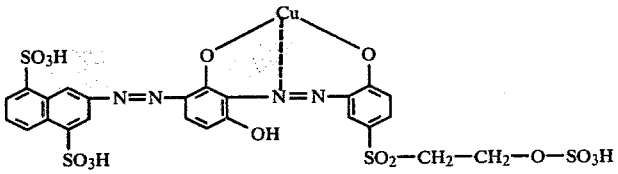 | 0.2 | 3,000 | decyl radical and hexyl radical | 6 | 1:8 | sand brown |
| 16 | 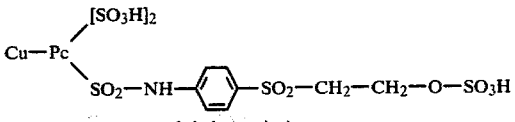 | 4 | 1,200 | butylated on both sides | 2 | | |
| | (Cu—Pc = copper phthalocyanine) | | and auxiliaries consisting of 28% by weight of the sodium salt of sulfonated and oleic acid butylamide, 16% by weight of oleic acid sulfonate 56% by weight of water and salts | | 1 | 1:6 | turquoise blue |
| 17 | Reactive Red 23-C.I. No. 16,202 | 3 | 5,000 | butylated on both sides | 2 | 1:6 | red |
| 18 | Reactive Red 23-C.I. No. 16,202 | 0.8 | 4,500 | butyl radical and ethyl radical | 4 | 1:4 | red |

-continued

| Ex. No. | Dyes: Structure | Amount % | Auxiliaries: Block polymer EO + PO molecular weight | End groups | Amount g/l | Liquor ratio | Color shade |
|---|---|---|---|---|---|---|---|
| 19 | 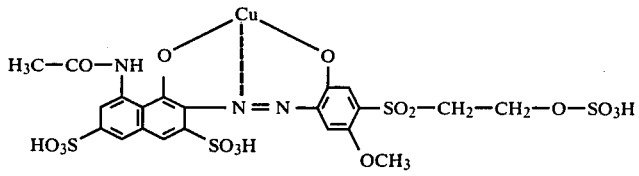 | 5 | 1,000 | not alkylated | 2 | 1:6 | blue |
| | 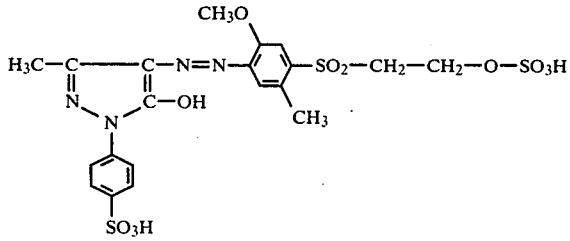 | 0.13 | and 1,4-butanediol monostearate, esterified with 7 moles of EO | | 1 | | |
| 20 | Reactive Blue 19-C.I. No. 61,200 | 0.5 | as Example 11 and polyethylene glycol of molecular weight 800 | | 2<br>2 | 1:3 | light blue |

EXAMPLE 21

65 kg of a cotton fabric are to be dyed on a winch beck at a liquor ratio of 1:5.

This is done by preparing a liquor, using water at 35° C., to which are added 3 g/l of a block polymer which is formed from ethylene oxide and propylene oxide, has an average molecular weight of 5,000 and has both its end groups butylated, and working the textile material for 5 minutes in the prepared liquor to distribute the auxiliary uniformly.

0.2 g/l of calcined sodium carbonate and 650 g (=1% on the weight of the goods) of the dye Direct Black 71 of C.I. No. 25,040, dissolved in hot water, are then also added to this blank dye bath while the winch is running. The liquor is now brought to the boil in the course of 10 minutes and is kept at the boil for 10 minutes. The supply of steam for heating is then shut off and 15 kg of calcined sodium sulfate are introduced into the dye bath. The goods are then dyed for a further 30 minutes with the steam shut off.

A level gray dyeing of the cotton fabric is obtained after the textile material treated in this way has been rinsed with water repeatedly. No difficulties which could be attributed to poor running behavior of the goods occurred here.

EXAMPLE 22

8 ropes of a bleached cotton flannel are dyed in a winch beck at a liquor ratio of 1:7. The weight of the goods is 92 kg.

This is done by adding 2 g/l of a block polymer which is formed from ethylene oxide and propylene oxide, has an average molecular weight of 5,000 and has both its end groups butylated, to a bath of 650 l of water at 35° C., and working the textile material for approximately 5 minutes in this liquor.

0.5 g/l of the dye Solubilized Vat Green 1 of C.I. No. 59,826, 0.2 g/l of calcined sodium carbonate, 1 g/l of sodium 2,2'-dinaphthylemthane-6,6'-disulfonate and 0.2 g/l of sodium nitrite are then added, dissolved in hot water, to the blank dye bath. After the winch has been running for 10 minutes, 16.5 kg of cacined sodium sulfate are also introduced and the material in rope form is then dyed for a further 20 minutes at a falling temperature.

The vat dye is now developed by adding to the dye bath 2 g/l of concentrated sulfuric acid, diluted with water in the ratio of approximately 1:10. The development is complete after the goods have been treated for a further 10 minutes.

The dyed textile material is now rinsed with water and is then soaped at the boil for 10 minutes in an aqueous bath to which have been added 2 g/l of calcined sodium carbonate and 1 g/l of oleyl-methyl-taurine. After the final rinsing with water, a level, fast green dyeing is obtained.

No running difficulties caused by the low liquor ratio occur during the dyeing.

In contrast to this, in an analogous dyeing in which the butylated block polymer is not added, the goods frequently get stuck. Because of this unlevelnesses and/or creases are produced after development.

The Examples which follow are carried out at varying liquor ratios, using other dyes, but under conditions which are otherwise the same. They give equally good results in respect of the running behavior of the goods:

| Example No. | Dyes: Structure | Dyes: Amount g/l | Auxiliaries: Block polymer EO + PO: Molecular weight | Auxiliaries: End groups | Auxiliaries: Amount g/l | Liquor ratio | Color shade |
|---|---|---|---|---|---|---|---|
| 23 | Solubilized Vat Red 10 C.I. No. 67,001 | 0.2 | 2,300 | butylated, and the palmityl radical | 3 | 1:4 | red |
| 24 | Solubilized Vat Orange 11 C.I. No. 70,806 | 0.3 | 1,200 and an auxiliary consisting of 28% by weight of the sodium salt of sulfonated oleic acid butylamide, 16% by weight of oleic acid sulfonate and 56% by weight of water and salts | not alkylated | 2<br>1 | 1:4 | yellow |
| 25 | Solubilized Vat Violet 8 C.I. No. 73,601 | 1.5 | 800 and 1,4-butanediol monostearate etherified with 7 moles of EO | butyl radical on one side | 2<br>2 | 1:6 | violet |
| 26 | Solubilized Vat Orange 11 C.I. No. 70,806 | 0.38 | 2,000 and polyethylene glycol with a molecular weight of 600 | not alkylated | 2 | 1:8 | yellow |

EXAMPLE 27

76 kg of a cotton knitted fabric are to be dyed in a winch beck at a liquor ratio of 1:8.

This is done by charging the winch beck with 580 l of water at 60° C. and 3 g/l of a block polymer which is formed from ethylene oxide and propylene oxide and has an average molecular weight of 2,200 and in which one end group has been ethylated, and the goods are worked for approximately 5 minutes in this liquor to achieve good wetting.

2,280 g (=3% on the weight of the goods) of the dye Vat Orange 7 of C.I. No. 71,105 are then made into a paste with the aid of a little alcohol and water at 60° C. and the paste is added to the blank bath and uniformly distributed in the goods while the winch is running for 10 minutes. In the course thereof, the temperature of the liquor is kept at 60° C.

42 $cm^3$/l of 32.5% strength sodium hydroxide solution and 10 g/l of hydrosulfite (sodium dithionite) are now also added to the dye bath in the sequence indicated and the textile material is dyed for a further 30 minutes (while monitoring the progress of the reduction with yellow vat paper).

The goods treated in this way are then thoroughly rinsed with water and the dye is then oxidized with the aid of a fresh aqueous liquor containing 2 $cm^3$/l of hydrogen peroxide.

After the dyeing has been rinsed again in water, it is soaped at the boil for 10 minutes in an aqueous liquor to which have been added 3 g/l of calcined sodium carbonate and 1 g/l of oleylmethyltaurine.

A brilliant orange dyeing is obtained after rinsing the goods until they are clear. No running difficulties occur during dyeing, in spite of the short liquor ratio.

Similar results are obtained if the auxiliaries or combinations of auxiliaries which follow are employed instead of the block polymers cited:

| Example No. | Auxiliary: Molecular weight of the block polymer formed from EO + PO | End groups |
|---|---|---|
| 28 | 1,200 | butyl radical and dodecyl radical |
| 29 | 2,200 and 1 g/l of an auxiliary consisting of 28% by weight of the sodium salt of sulfonated oleic acid butylamide, 16% by weight of oleic acid sulfonate and 56% by weight of water and salts | butylated on both sides |
| 30 | 3,000 and 2 g/l of 1-4-butanediol monostearate, etherified with 7 moles of EO | nonyl radicals on both sides |
| 31 | 300 1 g/l of polyethylene glycol with a molecular weight of 400 | butyl radical on one side |

EXAMPLE 32

20 kg of a cotton Interlok material, ready for dyeing, are dyed in rope form in a winch beck with an aqueous dyeing liquor of 1601 which has been prepared as follows: 600 g of the reactive dye of the formula

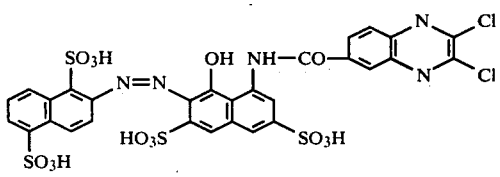

in a commercially available form and condition, are dissolved in 20 l of boiling water.

7.5 kg of calcined sodium sulfate and 8 g/l of a softener consisting of 28% by weight of the sodium salt of sulfonated oleic acid butylamide, 16% by weight of oleic acid sulfonate and 56% by weight of water and salts are dissolved in the remaining 140 l of water at 60° C.

The dye solution and the salt/auxiliary solution are now combined to give the dyeing liquor and the textile material is dyed in this, at first for 30 minutes at 40° C. 3.5 kg of sodium carbonate, dissolved in water, are then added while the winch is running, and the goods are dyed to completion for a further 60 minutes at 40° C. The dyed material in the form of ropes is then rinsed with water, soaped and dried.

In spite of the quantity of liquor being reduced to a ratio of 1:8, a level, crease-free red dyeing is obtained.

EXAMPLE 33

50 kg of a boiled cotton knitted fabric (fine-rib) of good absorbency are prepared for dyeing in 5 ropes in a winch beck.

100 l of the aqueous liquor, of the total of 250 l, are used to wet out the goods. The following are dissolved in these 100 l of water:

6 g/l of the disodium salt of N-octadecyl-α-sulfosuccinamic acid of the formula

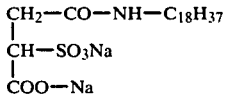

2 g/l of a 50% strength aqueous formulation of the condensation product of 1,4-butanediol monostearate, etherified with 7 moles of ethylene oxide, and 2 g/l of a 40% strength aqueous formulation consisting of a mixture of 60% of the sodium salt of sulfonated oleic acid dibutylamide and 40% of oleic acid sulfonate.

A further 50 l of liquor are used to dissolve the dye and 100 l are used to dissolve the salt and alkali required.

For a 2.5% strength dyeing, 1.25 kg of the commercially available reactive dye of the formula

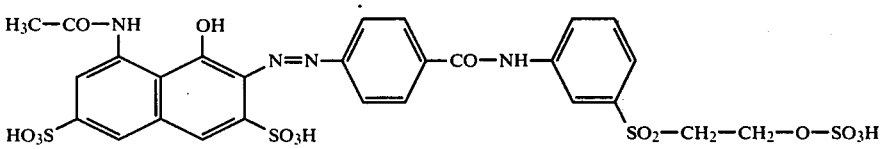

are dissolved in 20 l of boiling water and the solution is further diluted with a further 30 l of hot water.

7.5 kg of calcined sodium sulfate and 750 cm³ of 32.5% strength sodium hydroxide solution are dissolved in 100 l of warm water (60° C.).

These three solutions are now run into the winch beck and are combined to form the dyeing liquor. By virtue of its content of the auxiliary, this dyeing liquor distributes itself very rapidly and uniformly in the ropes of knitted fabric. The textile material is then dyed in the customary manner. After a dyeing time of 90 minutes at 40° C., the ropes are rinsed with water, after-treated in the customary manner and dried.

A level red dyeing of the cotton knitted fabric is obtained. In spite of the liquor ratio being reduced to 1:5, virtually no running difficulties have occurred. The quality of the dyeing has not been impaired.

Comparison Test

The test was carried out as in Example 1, but the auxiliary was not added. After drying, the dyeing exhibited unlevelnesses caused by loop distortion and poor removal of folds.

EXAMPLE 34

8 ropes of a pretreated cotton knitted fabric weighing 96 kg are dyed in a winch beck at a liquor ratio of 1:8.

This is done by adding 3 g/l of a 50% strength aqueous formulation of the disodium salt of N-octadecyl-α-sulfosuccinamic acid and 3 g/l of a 50% strength aqueous formulation consisting of a mixture of 28% of the sodium salt of sulfonated oleic acid butylamide, 16% of oleic acid sulfonate and 56% of water, to a liquor of 770 l of water, at 50° C., and working the goods for approximately 5 minutes in this liquor.

2.2% (on the weight of the dry goods) of the dye Direct Black 51 of C.I. No. 27,720 are now dissolved in boiling water and this solution is added, together with 0.2 g/l of calcined sodium carbonate, to the bath while the winch is running.

The liquor is then brought to the boil and, 5 minutes after it has reached boiling point, 15.5 kg of calcined sodium sulfate are introduced, the supply of steam for heating is shut off and the textile material is dyed for a further 40 minutes in the slowly cooling bath. The goods dyed in this way are then rinsed with water.

A level gray dyeing is obtained. Running difficulties have not occurred in this dyeing operation, in spite of the shortened liquor ratio.

EXAMPLE 35

60 kg of a cotton fine-rib knitted fabric in the raw condition are wetted out at 30°–40° C. in a winch beck with an aqueous liquor containing 50 cm³/l of isopropyl alcohol, 5 cm³/l of butanol and 2 g/l of a wetting agent based on sodium diisobutylnaphthalenesulfonate, and are rinsed. After this treatment, 180 l of water remain in the goods.

In order to dye at a liquor ratio of 1:8, a further 300 l of aqueous liquor are prepared containing 720 g (=2% relative to the weight of the dry goods) of the commercially available dye Reactive Blue 4 of C.I. No. 61,205, and 1,440 g (=3 g/l calculated on the total liquor of 480 l) of a 60% strength aqueous formulation of the disodium salt of N-tallow fatty alkyl-α-sulfosuccinamic acid of the formula

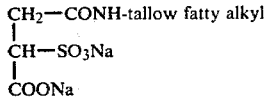

(tallow fatty alkyl corresponds to $C_{14}$–$C_{16}$ and to an average molecular weight of 270), 960 g (=2 g/l) of a 50% strength aqueous formulation consisting of a mixture of 28% of the sodium salt of sulfonated oleic acid butylamide, 16% of oleic acid sulfonate and 56% of water and salts, and 50 g/l of calcined sodium sulfate and 17 $cm^3$/l of 32.5% strength sodium hydroxide solution.

This liquor is now added to the wet, running ropes and the goods are dyed for 90 minutes at room temperature. The dyeing is then rinsed with water and after-treated in the manner customary for reactive dyeings.

A clear, level blue dyeing of the knitted fabric is obtained. Loop distortion and creasing have not occurred.

EXAMPLE 36

7 ropes of a knitted fabric made from a 50:50 polyester fiber/cotton mixture and weighing 83 kg are dyed in a winch beck at a liquor ratio of 1:8.

The dyeing liquor is prepared by dissolving 950 g (=2.3% relative to the weight of the cotton constituent) of the commercially available reactive dye of the formula

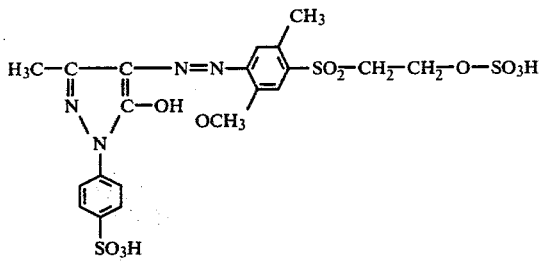

and 125 g (=0.3% relative to the weight of the cotton constituent) of the commercially available dye Reactive Orange 16 of C.I. No. 17,757, in 40 liters of boiling water.

The winch beck itself is now charged with 620 liters of water at 50° C. which contains as additives: 2 g/l of the Na salt of N-coconut fatty alkyl-α-sulfosuccinamic acid, 3 g/l of a 40% strength aqueous formulation consisting of a mixture of 60% of the sodium salt of sulfonated oleic acid dibutylamide and 40% of oleic acid sulfonate, 0.5 g/l of polyethylene glycol having an average molecular weight of 800, 50 g/l of calcined sodium sulfate, 5 g/l of calcined sodium carbonate and 1.5 $cm^3$/l of 32.5% strength sodium hydroxide solution.

The ropes are wetted out for 5 minutes with this liquor while the winch is running.

After the dye solution has been added, the winch is run at an increased speed for 5 minutes and the goods are then dyed for a further 90 minutes with the winch running at normal speed. The dyed textile material is then rinsed with water and after-treated in the manner customary for reactive dyeings.

A clear, completely level orange dyeing of the knitted fabric is obtained. In spite of the short liquor ratio of 1:8, no running difficulties or defects stemming therefrom occurred.

EXAMPLE 37

10 ropes of a cotton knitted fabric weighing 120 kg are boiled in the customary manner in a winch beck and are then rinsed with hot and cold water. After this pretreatment, 400 l of water remain in the ropes.

The following are dissolved in the further 200 l of water which are required for a liquor ratio of 1:5: 3.6 kg (=3% relative to the weight of the goods) of the commercially available reactive dye of the formula

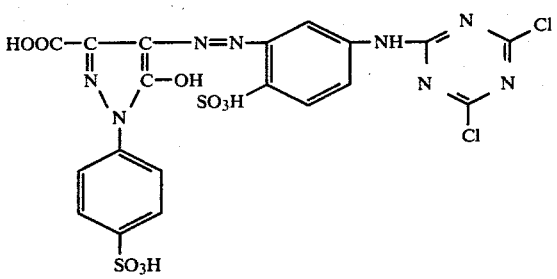

0.6 kg (=0.5% relative to the weight of the goods) of the commercially available dye Reactive Blue 4 of C.I. No. 61,205, 30 kg of calcined sodium sulfate (=50 g/l calculated on 600 l of liquor) and 9 l of 32.5% strength sodium hydroxide solution (15 $cm^3$/l).

Separately from this dye liquor, 1.2 kg (=2 g/l) of the ammonium salt of N-octadecyl-γ-aminopropyl-α-sulfosuccinamide and 1.8 kg of a 50% strength aqueous formulation of a mixture consisting of 28% of the sodium salt of sulfonated oleic acid butylamide, 16% of oleic acid sulfonate and 56% of water, are emulsified in a little water (60° C.) and this solution is distributed in the wet goods for 5 minutes while the winch is running.

The 200 l of solution of dye and chemicals, which had been prepared previously, are now introduced at approximately 40° C. into the winch beck and are also distributed in the textile material for 5 minutes, with the winch running rapidly, in the course of which the liquor cools. The temperature of the liquor is now increased to 40° C. once more with the winch running at normal speed and the bath is kept for 1 hour at this temperature. The dyed goods are then rinsed with water and after-treated in the customary manner.

A lime-green, level and crease-free dyeing is obtained, in spite of the liquor ratio being shortened to 1:5. The dyeing requires about 15% less dye for the same depth of color as compared with an identical dyeing produced at a liquor ratio of 1:20.

EXAMPLE 38

10 ropes of a cotton knitted fabric weighing 120 kg are boiled in the customary manner in a winch beck and are then rinsed with hot and cold water. After this pretreatment, 400 l of water remain in the ropes.

The following are dissolved in the further 200 l of water which are required for a liquor ratio of 1:5: 6 g/l of the commercially available dye Solubilized Vat Orange 1 of C.I. No. 59,106, 20 g/l of sodium sulfate (calculated on 600 l of liquor) and 0.5 g/l of calcined sodium carbonate.

5 g/l of a 50% strength aqueous formulation of a mixture consisting of 28% of the sodium salt of sulfonated oleic acid dibutylamide, 16% of oleic acid sulfonate and 56% of water, and 2 g/l of a sulfosuccinamide of the formula

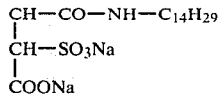

are dissolved or emulsified separately in a little water and this solution is distributed in the wet goods for 6 minutes while the winch is running. The 200 l of solution of dye and chemicals which had been prepared previously are now run at approximately 60° C. into the winch beck and are also distributed in the textile material for 5 minutes with the winch running rapidly. The goods are then dyed for 1 hour with the winch running at normal speed.

The fiber material is then rinsed with water and the dye is then developed by treatment, for 10 minutes, in a cold bath consisting of 1,200 l of water containing 5 $cm^3$/l of 96% strength sulfuric acid and 1 g/l of sodium nitrite. The dyeing is now, in addition, soaped at the boil for 20 minutes with an aqueous bath containing 5 g/l of calcined sodium carbonate and 0.5 g/l of oleylmethyltaurine.

A golden-yellow, fast, level and crease-free dyeing is obtained, in spite of the liquor ratio being shortened to 1:5. The dyeing requires about 20% less dye for the same depth of color as compared with an identical dyeing produced at a liquor ratio of 1:20.

EXAMPLE 39

7 ropes of a cotton knitted fabric weighing 83 kg are dyed in a winch beck at a liquor ratio of 1:8.

The dyeing liquor is prepared by dissolving 2.3%—relative to the weight of the goods—of the commercially available dye Direct Yellow 28 of C.I. No. 19,555 and 0.3%—relative to the weight of the goods—of the commercially available dye Direct Red 81 of C.I. No. 29,160 in 40 l of boiling water.

The winch beck itself is charged with 620 l of water at 80° C. which contains the following additives: 3 g/l of a 40% strength aqueous formulation of a mixture of 60% of the sodium salt of sulfonated oleic acid butylamide and 40% of oleic acid sulfonate, and 3 g/l of a sulfosuccinamide of the formula

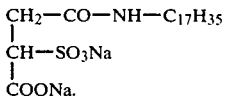

The ropes are wetted out for 5 minutes with this liquor.

After the dye has been added to the liquor, the winch is run for 5 minutes at an increased speed and the textile material is then dyed for a further 90 minutes with the winch running at normal speed. The dyeing which has been produced is then rinsed with water until it is clear.

A clear, completely level orange dyeing of the knitted fabric is obtained. In spite of the short liquor ratio of 1:8, no running difficulties or defects stemming therefrom occurred.

EXAMPLE 40

7 ropes of cotton terry-towelling weighing 140 kg are dyed in a winch beck at a liquor ratio of 1:8.

The dyeing liquor is prepared by dissolving 6.5%—relative to the weight of the dry goods—of the dye Solubilized Sulfur Green 2 of C.I. No. 53,572 and 1%—relative to the weight of the dry goods—of the dye Solubilized Sulfur Brown 51 of C.I. No. 53,328 in 80 l of water heated to 60° C.

The winch beck itself is charged with 1,000 l of water at 50° C. and this bath is provided with the following additives: 4 g/l of a mixture of auxiliaries consisting of 20% of the disodium salt of N-stearyl-α-sulfosuccinamic acid, 20% of the sodium salt of sulfonated oleic acid butylamide, 10% of oleic acid sulfonate, 2% of polyethylene glycol with an average molecular weight of 400 and 48% of water and salts, 5 g/l of calcined sodium carbonate, 1 $cm^3$/l of 32.5% strength sodium hydroxide solution, 3 $cm^3$/l of a 15% strength aqueous solution of a sodium polysulfide $Na_2S_x$ (x=2–5) and 8% of an aqueous solution of sodium hydrogen sulfide (NaHS).

The goods are worked for 5 minutes in this blank bath and the dye solution is then added. After a running time of 20 minutes the temperature of the liquor is increased to 80° C. and 20 g/l of calcined sodium sulfate are then added and the textile material is dyed for a further 40 minutes at 80° C. The goods are then given a cold rinse with overflowing water and the dye is then oxidized at 30°–35° C. in the course of 20 minutes in a fresh aqueous liquor containing 2% of 40% strength hydrogen peroxide and the dyeing is then acidified with the aid of a cold aqueous liquor containing 1 $cm^3$/l of 60% strength acetic acid.

The dyeing is completed by re-washing the goods treated in this way in an aqueous liquor at 40° C. to which 0.5 g/l of oleylmethyltaurine has been added, and by subsequent rinsing with water.

A level olive dyeing of the dyed material is obtained. In spite of the rough texture of the goods and the short liquor ratio (1:8), no running difficulties have occurred.

EXAMPLE 41

80 kg of a cotton knitted fabric are to be dyed on a winch beck at a liquor ratio of 1:6.

This is done by preparing a liquor of 480 l of water at 60° C. and charging this liquor with 8 g/l of a 15 percent strength by weight aqueous formulation of auxiliaries consisting of 9% by weight of the disodium salt of the sulfuric acid half-ester of glycerol 1,3-bis-(2-ethylhexyl) ether and 1% by weight of polyethylene glycol having an average molecular weight of 6,000, and working the textile material for 5 minutes in the prepared liquor in order to distribute the auxiliary uniformly.

1.6 kg (=2% on the weight of the goods) of the dye Direct Black 51 of C.I. No. 27,720, dissolved in 10 l of boiling water, are then also added to this blank dye bath while the winch is running. The liquor is now brought to the boil and 8 kg (=10% of the content of goods) of calcined sodium sulfate are then added. The supply of steam for heating is then shut off and the goods are dyed under these conditions for a further 30 minutes in the bath, which is cooling.

After the textile material treated in this way has subsequently been rinsed with water until it is clear, a level gray dyeing is obtained. No difficulties which could be attributed to poor running behavior of the knitted fabric and which would have to be regarded as a consequence of the short liquor ratio of 1:6, have occurred here.

What is claimed is:

1. In a process for dyeing mesh fabrics and woven fabrics, made from cellulose fibers and mixed yarns thereof, in rope form on a winch beck or jet dyeing apparatus by the exhaustion method at a short liquor ratio in the presence of at least one auxiliary, using an aqueous liquor containing dyes or dye precursors which are suitable for the type of fiber and optionally fixing chemicals, the improvement comprising dyeing said fabrics in rope form on a winch beck or jet dyeing apparatus at a liquor ratio of 1:3 to 1:8, on the weight of the dry goods and in the presence of 2–8 g/l of an anionic or non-ionic, aliphatic softener or mixture thereof, as an auxiliary for said dyeing at said short liquor ratio.

2. A process as claimed in claim 1, wherein an oxethylate is used as the non-ionic softener.

3. A process as claimed in claim 2, wherein an oxethylate having 8–32 C atoms is used.

4. A process as claimed in claim 3, wherein polyethylene glycol having an average molecular weight between 400 and 800 is used.

5. A process as claimed in claim 3, wherein an 80–100 percent strength by weight formulation of 1,4-butanediol monostearate, etherified with 7 moles of ethylene oxide, is used.

6. A process as claimed in claim 3, wherein a 20–50 percent strength by weight formulation of a condensation product formed from stearic acid and ammonia which has been oxethylated with 5 moles of ethylene oxide, is used.

7. A process as claimed in claim 2, wherein an ethylene oxide/propylene oxide block polymer which can optionally be alkylated on both sides, is used.

8. A process as claimed in claim 7, wherein an ethylene oxide/propylene oxide block polymer which contains a $C_8$ to $C_{18}$ alkyl radical on both sides, is used.

9. A process as claimed in claim 7, wherein an ethylene oxide/propylene oxide block polymer which contains a $C_1$ to $C_7$ alkyl radical on both sides, is used.

10. A process as claimed in claim 9, wherein an ethylene oxide/propylene oxide block polymer which contains a butyl radical on both sides, is used.

11. A process as claimed in claim 7, wherein an ethylene oxide/propylene oxide block polymer which contains a $C_8$ to $C_{18}$ alkyl radical at one end and a $C_1$ to $C_7$ alkyl radical at the other end, is used.

12. A process as claimed in claim 7, wherein the non-alkylated ethylene oxide/propylene oxide block polymer has an average molecular weight of 220 to 5,200.

13. A process as claimed in claim 1, wherein anionic softeners having 8–32 C atoms are used.

14. A process as claimed in claim 13, wherein a sulfonated and oxethylated fatty acid condensation product in which the proportion of fatty acid which has not been reacted or has only been sulfonated is 3–60% by weight, is used.

15. A process as claimed in claim 13, wherein a 40–50 percent strength by weight mixture of sulfonated oleic acid butylamide and oleic acid sulfonate in a ratio of 2:1 to 1:1 is used.

16. A process as claimed in claim 15, wherein the oleic acid derivatives are, in addition, used as a mixture with a N-alkyl-α-sulfosuccinamic acid, or salt thereof, according to the general formula I $$\begin{array}{l} CH_2-CONH-R \\ | \\ CH-SO_3^{(-)}X^{(+)} \\ | \\ COO^{(-)}X^{(+)} \end{array} \qquad (I)$$

wherein R denotes a branched or unbranched alkyl or alkenyl group having 10 to 30 C atoms or a group of the formula $R'-NH-(CH_2)_n-$, n denotes an integer from 2 to 4, X denotes a sodium, potassium or ammonium ion and R' has the same meaning as R.

17. A process as claimed in claim 13, wherein a N-alkyl-α-sulfosuccinamic acid, or salt thereof, according to the general formula I $$\begin{array}{l} CH_2-CONH-R \\ | \\ CH-SO_3^{(-)}X^{(+)} \\ | \\ COO^{(-)}X^{(+)} \end{array} \qquad (I)$$

wherein R denotes a branched or unbranched alkyl or alkenyl group having 10 to 30 C atoms or a group of the formula $R'-NH-(CH_2)-$, n denotes an integer from 2 to 4, X denotes a sodium, potassium or ammonium ion and R' has the same meaning as R, is used as a mixture with a glycerol ether derivative according to the general formula II $$\begin{array}{l} CH_2-OR^1 \\ | \\ CH_2-O-(CH_2CH_2O)_Y-Z \\ | \\ CH_2-OR^2 \end{array} \qquad (III)$$

wherein $R^1$ and $R^2$ denote identical or different, branched or unbranched $C_4$–$C_8$ alkyl groups, Y denotes zero or a number from 1 to 4 and Z denotes a group of the formulae $-(CH_2)_m-COOMe$, $-SO_3Me_2$ or $PO_3Me_3$, m denoting 1, 2 or 3 and Me denoting an alkali metal ion, ammonium ion or trialkylammonium ion.

18. A process as claimed in claim 1, wherein ropes of goods which are wet from the pre-treatment—their moisture content being counted towards the liquor ratio of 1:3 to 1:8—are dyed.

19. A process as claimed in claim 1, wherein a part of the quantity of liquor used for dyeing is used to wet out the ropes of goods and the total dyeing liquor is only formed in the winch beck or jet dyeing apparatus from this part, a part which is used to dissolve the dye and a part which is used to dissolve the dyeing chemicals and auxiliaries.

20. A process as claimed in claim 1, wherein reactive dyes are used as the dyes.

21. A process as claimed in claim 1, wherein direct dyes are used as the dyes.

22. A process as claimed in claim 1, wherein leuco vat ester dyes are used as the dyes.

23. A process as claimed in claim 1, wherein vat dyes are used as the dyes.

24. A process as claimed in claim 1, wherein sulfur dyes are used as the dyes.

25. A process as claimed in claim 1, wherein components for producing water-insoluble azo developing dyes on the fiber are used as the dyes.

* * * * *